US011662134B2

(12) United States Patent
Desphande

(10) Patent No.: US 11,662,134 B2
(45) Date of Patent: May 30, 2023

(54) HOT AIRFLOW MANAGEMENT SYSTEMS AND METHODS FOR COOLERS

(71) Applicant: PEPSICO, INC., Purchase, NY (US)

(72) Inventor: Prashant Desphande, Haryana (IN)

(73) Assignee: PepsiCo. Inc., Purchase, NY (US)

( * ) Notice: Subject to any disclaimer, the term of this patent is extended or adjusted under 35 U.S.C. 154(b) by 0 days.

(21) Appl. No.: 15/775,184

(22) PCT Filed: May 7, 2018

(86) PCT No.: PCT/US2018/031306

§ 371 (c)(1),
(2) Date: May 10, 2018

(87) PCT Pub. No.: WO2018/208640

PCT Pub. Date: Nov. 15, 2018

(65) Prior Publication Data

US 2020/0064050 A1 Feb. 27, 2020

(30) Foreign Application Priority Data

May 10, 2017 (IN) ..... 20174106422

(51) Int. Cl.

*F25D 17/04* (2006.01)
*F25D 17/06* (2006.01)
*F25D 21/04* (2006.01)

(52) U.S. Cl.

CPC ..... *F25D 17/045* (2013.01); *F25D 17/06* (2013.01); *F25D 21/04* (2013.01)

(58) Field of Classification Search

CPC ..... F25D 17/045; F25D 17/06; F25D 21/04; F25D 2323/00264; F25D 2323/00271; F25D 23/003; A47F 3/0426; A47F 3/0408

See application file for complete search history.

(56) References Cited

U.S. PATENT DOCUMENTS 3,462,966 A * 8/1969 Reid ..... F25D 21/04 62/248
4,299,092 A * 11/1981 Ibrahim ..... F25D 21/125 62/81

(Continued)

FOREIGN PATENT DOCUMENTS

CN 105839103 A 8/2016
CN 106595175 A 4/2017

(Continued)

OTHER PUBLICATIONS

Kengo et al., Cold Air Circulation Type Flat Open Showcase. Dec. 22, 1995. JPH07332836A. Whole Document (Year: 1995).*

(Continued)

*Primary Examiner* — Larry L Furdge

(74) *Attorney, Agent, or Firm* — Sterne, Kessler, Goldstein & Fox P.L.L.C.

(57) ABSTRACT

Coolers with airflow management systems are disclosed. The coolers include a cabinet that has a door with a transparent section. A refrigeration unit is coupled to the cabinet. The refrigeration unit has an airflow inlet and an airflow outlet. The cross sectional area of the airflow outlet is less than the cross sectional area of the airflow inlet. The refrigeration unit is fluidly coupled to an airflow management system that is in fluid communication with the airflow outlet. The airflow management system includes discharge vents and turbulence reduction vents.

20 Claims, 7 Drawing Sheets

(56) References Cited

U.S. PATENT DOCUMENTS

| | | | | | |
|---|---|---|---|---|---|
| 4,977,754 | A * | 12/1990 | Upton | A47F 3/0408 | 221/150 R |
| 2016/0025402 | A1 * | 1/2016 | Ahn | F25D 17/065 | 62/419 |
| 2016/0106233 | A1 * | 4/2016 | Mitchell | A47B 87/0276 | 312/138.1 |

FOREIGN PATENT DOCUMENTS

| | | | | |
|---|---|---|---|---|
| DE | 20 2008 001 432 | U1 | | 6/2009 |
| JP | H07332836 | A | * | 12/1995 |
| JP | H09133450 | A | * | 5/1997 |
| JP | 2004239474 | A | * | 8/2004 |
| KR | 20020003767 | A | * | 1/2002 |
| WO | WO 2014/201892 | A1 | | 12/2014 |

OTHER PUBLICATIONS

Takenaka, Showcase, May 20, 1997, JPH09133450A, Whole Document (Year: 1997).*

Lee, Refrigerator, Jan. 15, 2002, KR2002-0003737A, Whole Document (Year: 2002).*

Kijima et al., Dew Condensation Water Draining Structure for Showcase, Aug. 26, 2004, JP2004239474A, Whole Document (Year: 2004).*

* cited by examiner

HOT AIRFLOW MANAGEMENT SYSTEMS AND METHODS FOR COOLERS

FIELD

Described embodiments relate to hot airflow management systems and methods for coolers. More particularly, the described embodiments relate to airflow management systems having discharge vents and turbulence reduction vents, and related methods.

SUMMARY

In some embodiments descried herein, a cooler includes a cabinet, a refrigeration unit, and an airflow management system. The cabinet has a door with a transparent section. The transparent section may be formed of glass, plastic, or other transparent materials. The refrigeration unit is coupled to the cabinet and includes an airflow inlet and an airflow outlet. A cross sectional area of the airflow inlet is greater than a cross sectional area of the airflow outlet. The airflow management system is in fluid communication with the airflow outlet. The airflow management system includes discharge vents and turbulence reduction vents. The discharge vents and the turbulence reduction vents are orthogonal.

The airflow management system is configured to redirect the flow of an air mass exiting the refrigeration unit through the airflow outlet. In some embodiments, the airflow management system redirects the flow of the air mass across a height of the transparent section.

The transparent section may comprise a substantial portion of a one side of the cooler. The height of the transparent section may greater than 95% the height of the cabinet. The height of the transparent section may also be greater than 85% the height of the cooler. The transparent section of the cooler may have a height that is between 6 ft and 6.5 ft. The reduced height of the refrigeration unit may be occupied by the cabinet to form a supplemental storage space. The supplemental storage space may be formed above the outlet of the refrigeration unit.

The refrigeration unit may include a condenser having coils. The coils may be located in the more narrow section of the refrigeration unit. The narrow section of the refrigeration unit may be the portion of the refrigeration unit that has the smaller cross section. The coils may form air mass channels that guide the air mass flowing through the refrigeration unit to the airflow outlet. According to some embodiments, the air mass channels are orthogonal to the door of the cooler. The width of the refrigeration unit (w) may also be constant through the cross sectional area of the outlet and the inlet. Thus, the change in cross sectional area from the inlet to the outlet is the result of a change in height of the refrigeration unit.

The cooler may have a cabinet height that is greater than 6 ft. The airflow management system may lessen the formation of condensation on the transparent portion of the cabinet when the interior of the cabinet has a temperature below 5° C. and the cooler is located in a high temperature and high humidity environment. A high temperature and high humidity environment may be described as one where the temperature exceeds 41° C. and the relative humidity exceeds 75%.

The airflow management system for a cooler may include a housing. The housing may be formed of a discharge panel and a side panel. The discharge panel and the side panel may be formed orthogonal to one another. Discharge vents may be formed in the discharge panel and turbulence reduction vents may be formed in the side panel. The airflow management system for a cooler may also include an arced plate interior the housing.

The housing may bend through 90°. In this way, an air mass meeting the arced plate may be redirected 90° relative to how the air mass met the arced plate. The discharge vents may be biased to direct the air mass nearer a surface of the transparent portion of the cooler. For example, the discharge vents may be biased towards a plane orthogonal to the discharge panel where the plane intersects a radius of the arced plate.

The arced plate may engage the side panel. For example, the arced plate may be fitted into a recess of the side panel such that the side panel supports the arced plate. The discharge vents may be formed of two or more rows of vents. For example, the discharge vents on the surface panel may include two rows and ten columns of vents.

According to some embodiments, a cooler may include a cabinet, a refrigeration unit, and an airflow management system. The cabinet may have a primary space and a secondary space. The secondary space may be an extension of the primary space. The refrigeration unit may have a first and a second portion. The height of the second portion of the refrigeration unit may be less than the height of the first portion of the refrigeration unit. The airflow management system may be fluidly coupled to the second portion. The cabinet may be disposed on the refrigeration unit such that the secondary space is disposed above the second portion. The cabinet and the refrigeration unit may form a rectangular profile.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
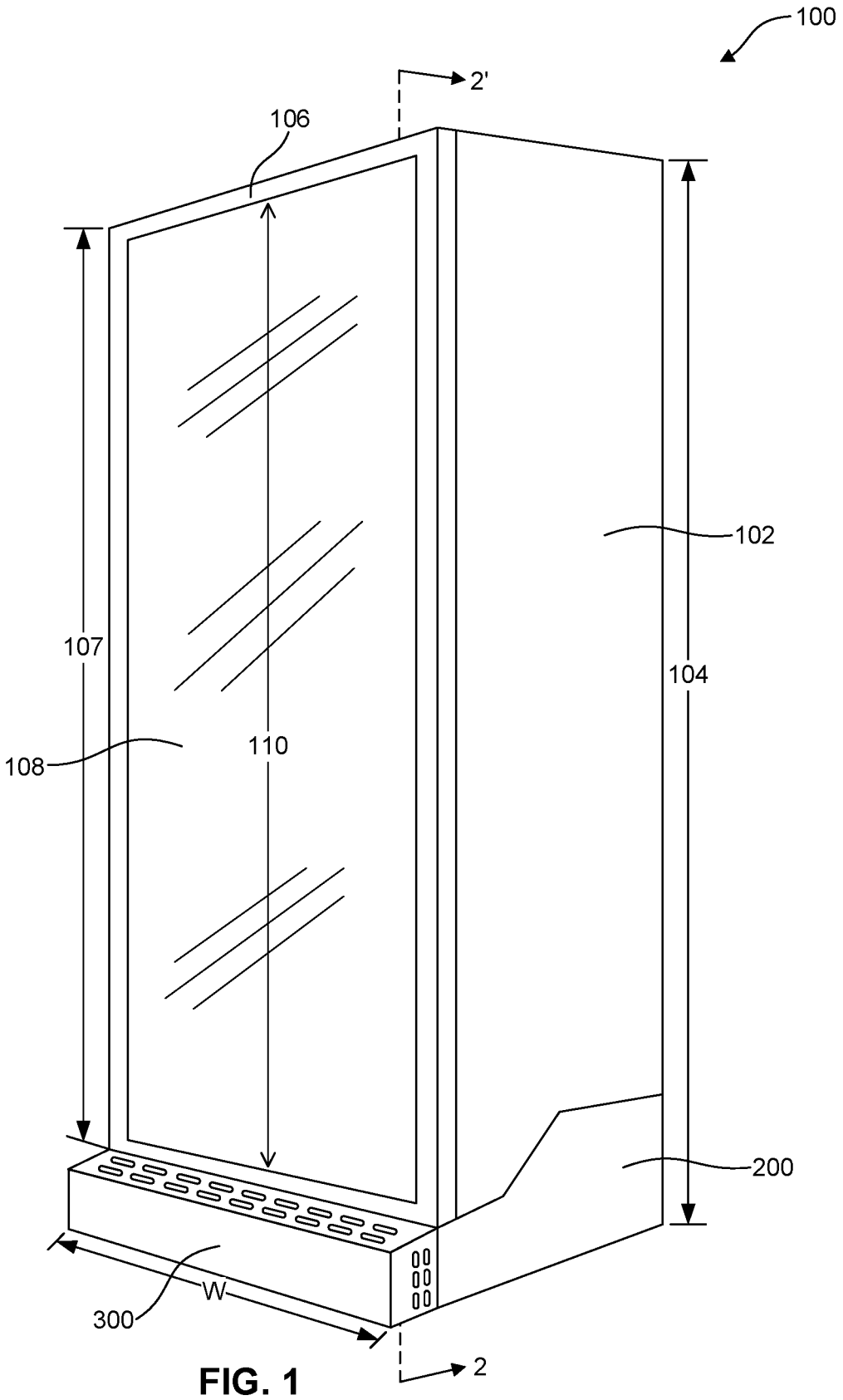
FIG. 1 shows a cooler with an airflow management system according to an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims. Accordingly, references to "one embodiment", "an embodiment". "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Other embodiments are discussed below with reference to the figures. However, those skilled in the art will readily appreciate that the detailed description given herein with respect to these figures is for explanatory purposes only and should not be construed as limiting. As used herein, ranges are inclusive of the end points, and "from," "between," "to," "and," as well as other associated language includes the end points of the ranges. As used herein, "approximately" or "about" may be taken to mean within 10% of the recited value, inclusive.

Merchants use coolers to keep products cold. Some coolers include a transparent section on the front of cooler. The transparent section may be made of glass or other transparent materials. The transparent section of the door allows consumers to see products in the cooler prior to making a selection. Clear visibility of the products in the cooler is important to producers, merchants, and customers. Clear visibility allows the product to be seen from a distance without opening the door of the cooler. This allows producers to not only to market the products, but also to convey greater brand recognition, or to promote upcoming or limited time products or promotions, even when the cooler is closed. Consumers require clear visibility of the products in the cooler so the customer can see what products are available and make purchases. Finally, merchants require clear visibility so consumers limit the amount of time the cooler door is open, improving the energy efficiency of the cooler.

In some environments, humidity forming on the transparent section obscures consumers' views of products in the cooler. Humidity on the transparent section limits brand recognition, makes it harder for consumers to identify products in the cooler, and may require consumers to open the cooler to clearly view products, unnecessarily wasting energy.

Coolers operating in high humidity and high temperature environments are particularly susceptible to condensation forming on the glass. Condensation forms when the temperature of a surface is less than the dew point temperature of water vapor in air. The dew point temperature increases as relative humidity increases. In high temperature high humidity environments, such as, for example, those with temperatures greater than 38° C. and a relative humidity above 65%, the dew point temperature may be only one to five degrees Celsius below the ambient temperature. For example, when the temperature is 40° C. and the relative humidity is 75%, the dew point temperature is 35° C. When the temperature is 40° C. and the relative humidity is 90%, the dew point temperature is 38° C. And when the temperature is 38° C. and the relative humidity is 75%, the dew point temperature is 33° C. Therefore, in the temperatures and the relative humilities described above, condensation will form on the transparent section of the cooler when the exterior of the transparent section is 35° C., 38° C., and 33° C., respectively.

A cooler has a cold interior to keep products at a temperature that is desirable to consumers. Beverage coolers may have an interior temperature of about 1° C. to 7° C. The cool interior reduces the temperature of the transparent section of the cooler. If the exterior of the transparent section cools below the dew point temperature, condensation will form on the exterior of the cooler. Ensuring that the temperature of the transparent portion remains above the dew point of the water vapor reduces the formation of condensation.

An embodiment of a cooler having an airflow management system configured to reduce the formation of condensation on a transparent section of the cooler is described in detail with reference to the accompanying figures.

In some embodiments, for example as shown in FIG. 1, a cooler 100 includes a cabinet 102. Cabinet 102 may store and display products. For example, cabinet 102 may store beverages other consumable products. Cabinet 102 may have a door 106 to access products inside cabinet 102. Door 106 includes transparent portion 108. Transparent portion 108 may be formed of glass or may be formed of other transparent materials such as, for example, Plexiglas, glass composite, or other suitable materials. According to some embodiments, cooler 100 also includes a refrigeration unit 200. Refrigeration unit 200 may be configured to cool the interior space of cabinet 102. Refrigeration unit 200 may be located under cabinet 102 and may support cabinet 102, for example, as shown in FIG. 1. Refrigeration unit 200 may include an airflow management system 300. Airflow management system 300 may be coupled to the front of refrigeration unit 200. Airflow management system 300 may be configured to redirect the flow of air entering airflow management system 300. Airflow management system 300 is fluidly coupled to refrigeration unit 200 and is located on the same side of cooler 100 as door 106 with transparent portion 108.

Cooler 100 has a cooler height 104. In some embodiments, cooler height 104 may be between 2 ft and 10 ft. In some embodiments, cooler height 104 is between 4 ft and 8 ft. Still in some embodiments, cooler height is between 6 ft and 7 ft. Door 106 has a door height 107 and transparent portion 108 has a transparent section height 110. According to some embodiments, transparent section height 110 is greater than 85% of cooler height 104. In some embodiments, transparent section height 110 is greater than 95% of cooler height 104. Transparent section height 110 may be greater than 95% of door height 107.

Figure 2:
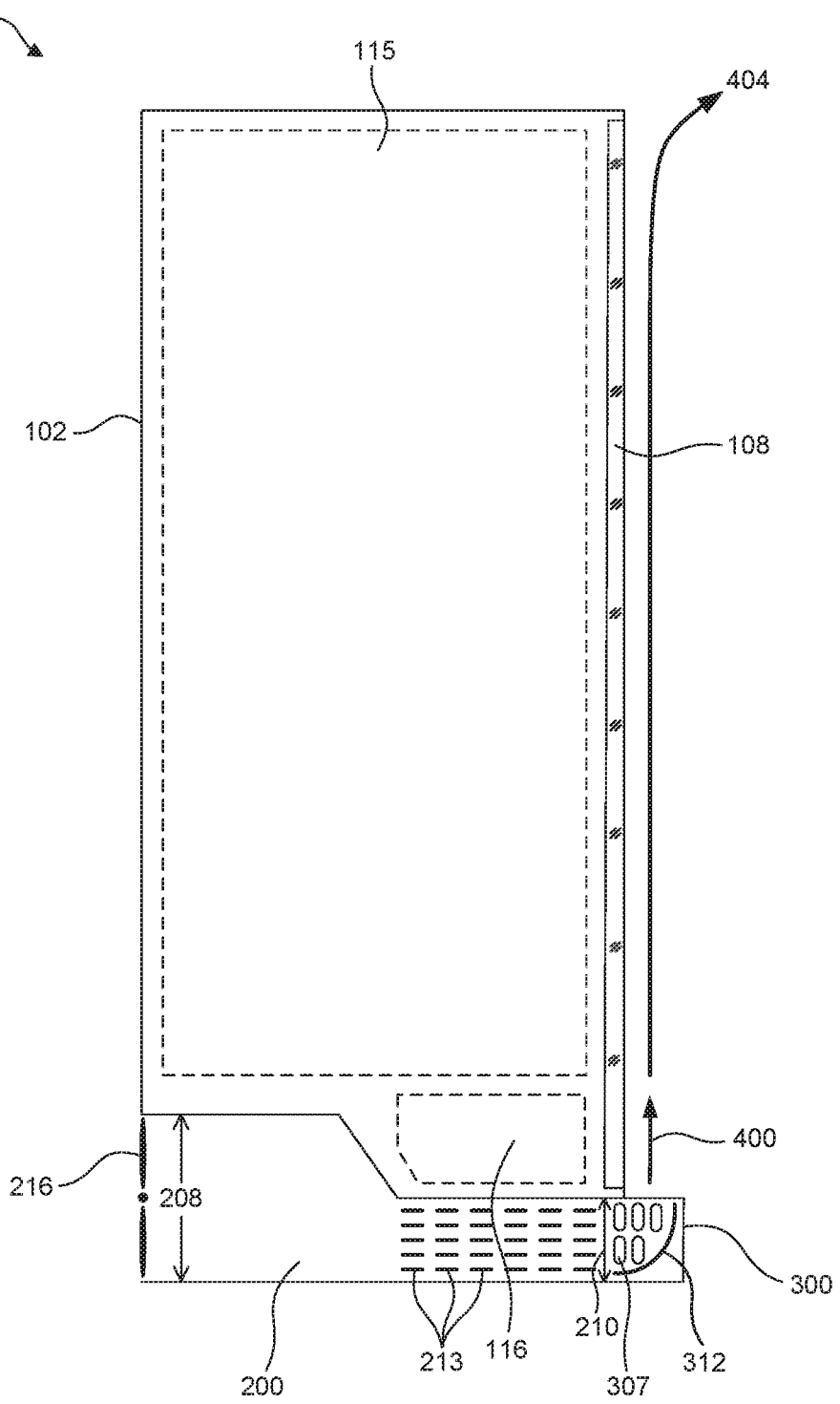
FIG. 2 shows a cross-sectional view of a cooler with an airflow management system taken along the line 2-2' in FIG. 1 according to an embodiment.

FIG. 2 shows a cross-sectional view of cooler 100 taken at the line 2-2' according to some embodiments. FIG. 2 shows cabinet 102 on refrigeration unit 200. Refrigeration unit 200 has a condenser fan 216 located at an airflow inlet 208. An airflow outlet 210, opposite airflow inlet 208, fluidly interfaces with airflow management system 300. FIG. 2 shows transparent portion 108 above airflow management system 300. In one embodiment, airflow management system 300 is configured such that air mass 400 exits airflow management system 300 and flows along a substantially laminar trajectory 404. Air mass 400 maintains a substantially laminar flow across the transparent section height 110 of cooler 100. A laminar flow is a uniform flow and lacks lateral mixing. In a laminar flow, there are no or minimal cross-currents perpendicular to the direction of the flow. There are also no or few eddies or swirls in the flow.

Cabinet 102 may different spaces formed by the geometry of cabinet 102. For example, FIG. 2 shows primary space 115 and secondary space 116 of cabinet 102. FIG. 2 shows secondary space 116 formed adjacent to primary space 115.

According to some embodiments, secondary space 116 may not be adjacent to primary space 115. As explained in greater detail with reference to FIG. 3 below, refrigeration unit 200 has a second portion with a height less than the first portion height. The negative space created by the reduced height of refrigeration unit 200 forms the space for secondary space 116 of cabinet 102. Secondary space 116 increases the useful space of cabinet 102 allowing merchants to make more products available to customers. This increases customer choice and increases the time between cooler 100 restocking. Making use of the space previously occupied by forward section 206 allows cooler 100 to maintain a rectangular shape allowing for easy integration into current merchant locations.

Figure 3:
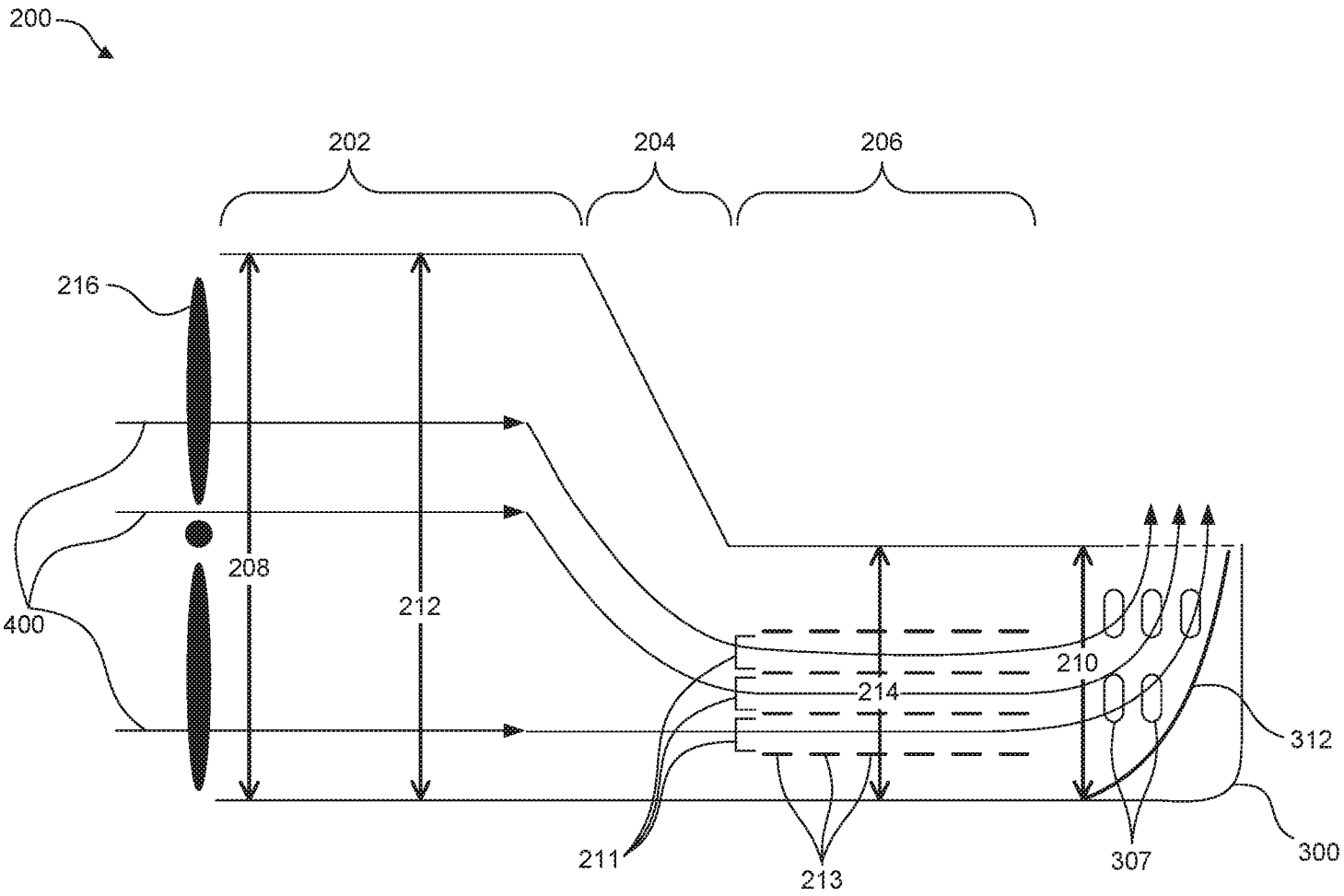
FIG. 3 shows a schematic cross-sectional view of a refrigeration system with an airflow management system taken along the line 2-2' in FIG. 1 according to an embodiment.

FIG. 3 is a detailed view of refrigeration unit 200 shown in FIG. 2. As shown in FIG. 3, refrigeration unit 200 has a rear section 202, a forward section 206, and an intermediate section 204. Refrigeration unit 200 may include an airflow inlet 208 and an airflow outlet 210. Rear section 202, intermediate section 204, and forward section 206 are fluidly connected such that a fluid may flow from an airflow inlet 208 formed at one side of rear section 202, through rear section 202, intermediate section 204, forward section 206, and out an airflow outlet 210 formed at one side of forward section 206. Rear section 202 has a rear section height 212 that defines a surface area of airflow inlet 208. Forward section 206 has a forward section height 214 that defines a surface area of airflow outlet 210. As shown in FIG. 3, in one embodiment, rear section height 212 is larger than forward section height 214, and the surface area of airflow inlet 208 is greater than the surface area of airflow outlet 210.

In some embodiments, refrigeration unit 200 may include several sections. The sections may be fluidly coupled and may have different cross-sectional areas. For example, as shown in FIG. 3, refrigeration unit 200 includes three sections. FIG. 3 shows rear section 202, intermediate section 204, and forward section 206. Rear section 202, intermediate section 204, and forward section 206 house components for cooling cabinet 102. As will be appreciated, refrigeration components (not shown) may include condensers, compressors, evaporators, evaporation values, or other suitable refrigeration components. FIG. 3 shows a condenser fan 216 disposed near airflow inlet 208 of refrigeration unit 200. Condenser fan 216 may be interior of rear section 202 exterior of rear section 202. For example, condenser fan 216 may be coupled to refrigeration unit but remain outside of rear section 202.

Condenser fan 216 brings an air mass 400 into refrigeration unit 200. Air mass 400 passes through rear section 202. Air mass 400 continues through intermediate section 204. Intermediate section 204 reduces the volume of air mass 400 passes. As the volume of air mass 400 decreases, the speed of air mass 400 increases. Therefore, when air mass 400 enters forward section 206, a velocity of air mass 400 is greater than the velocity of air mass 400 when it exits rear section 202. This corresponding increase in air mass 400's velocity allows air mass 400 to achieve a greater height when flowing up transparent portion 108. That is, the increased velocity allows air mass 400 exiting airflow outlet 210 and flowing into airflow management system 300 to obtain sufficient speeds to create a laminar flow up transparent section height 110.

As stated above, condenser fan 216 draws air mass 400 into refrigeration unit 200 from an environment. As air mass 400 travels through refrigeration unit 200, air mass 400 passes over condensing coils 213. Condensing coils 213 are arranged to form airflow channels 211. Airflow channels 211 smooth the flow of air mass 400, decreasing turbulence in the air flow, and increasing the laminar properties of the flow. Airflow channels 211 also direct the flow of air mass 400 so that the direction of the flow becomes substantially horizontal. As air mass 400 passes through airflow channels 211 and over condenser coils 213, air mass 400 absorbs heat ejected from condenser coils 213. Air mass 400, now moving with an increased velocity and warmed by condenser coils 213 passes through airflow outlet 210.

Figure 4:
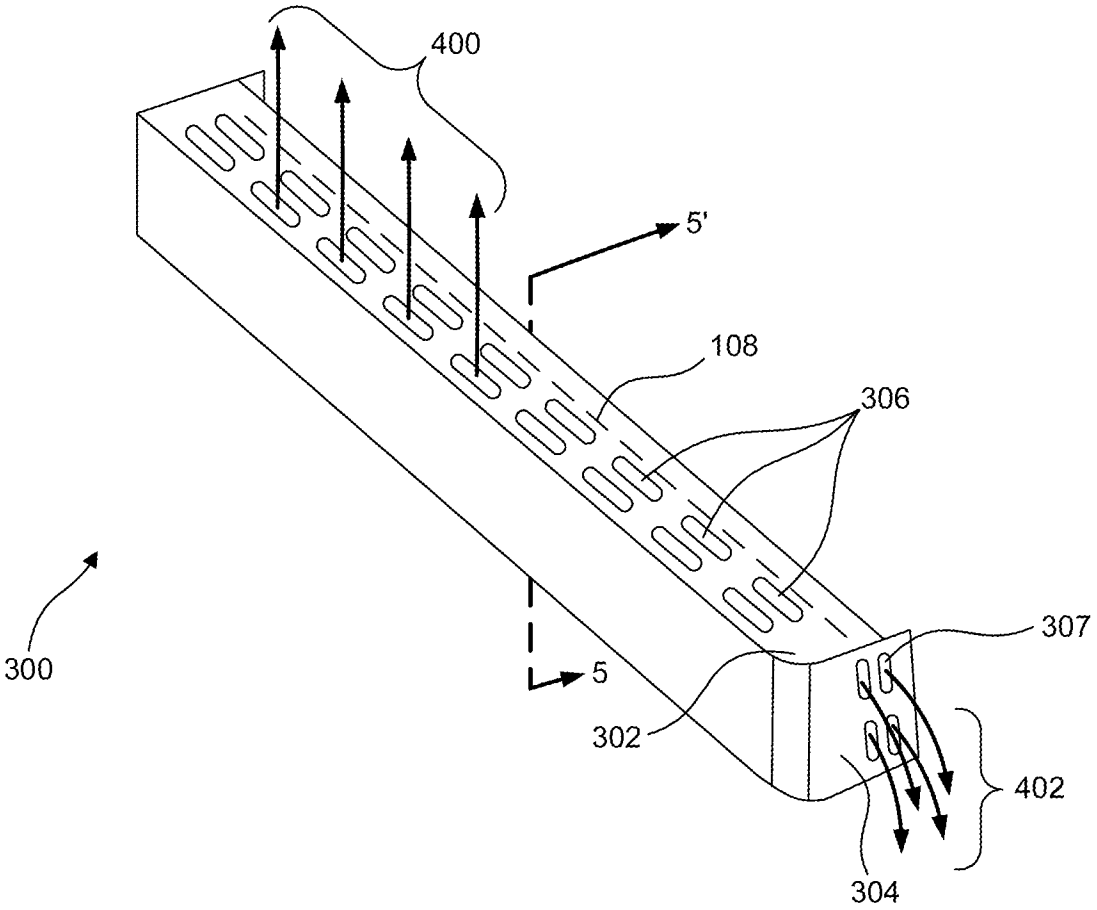
FIG. 4 shows an airflow management system according to an embodiment.

FIG. 4 shows a perspective view of airflow management system 300 according to an embodiment. Airflow management system 300 has a discharge panel 302 and side panel 304. Discharge panel 302 and side panel 304 are orthogonal. Door 106 having transparent section 108 is shown as environment in FIG. 4 for reference. When door 106 is closed on cabinet 102, a bottom surface of door 106 is located at a door closed position 108. Discharge panel 302 has discharge vents 306. Discharge vents 306 direct air mass 400 up the front of cabinet 102, creating airflow up the surface of door 106 and across transparent portion 108. Turbulence reduction vents 307 are formed into side panels 304. Turbulence reduction vents 307 allow portions of air mass 400 that do not have a substantially forward direction, i.e. in a direction parallel to airflow channels 211, to bleed out of airflow management system 300.

FIG. 4 shows turbulent air 402 exiting through turbulence reduction vents 307. Portions of air mass 400 exiting discharge panel 302 through discharge vents 306 form a laminar flow across the outer surface of transparent portion 108. Discharge vents 306 may have a variety of shapes or have a variety of configurations. For example, discharge vents 306 may have two, three, four, or more rows and several columns. Discharge vents 306 may be oval, as shown, triangular, round, square, or other shapes. Discharge vents 306 may have the same shapes and dimensions or may have different shapes and dimensions.

Figure 5:
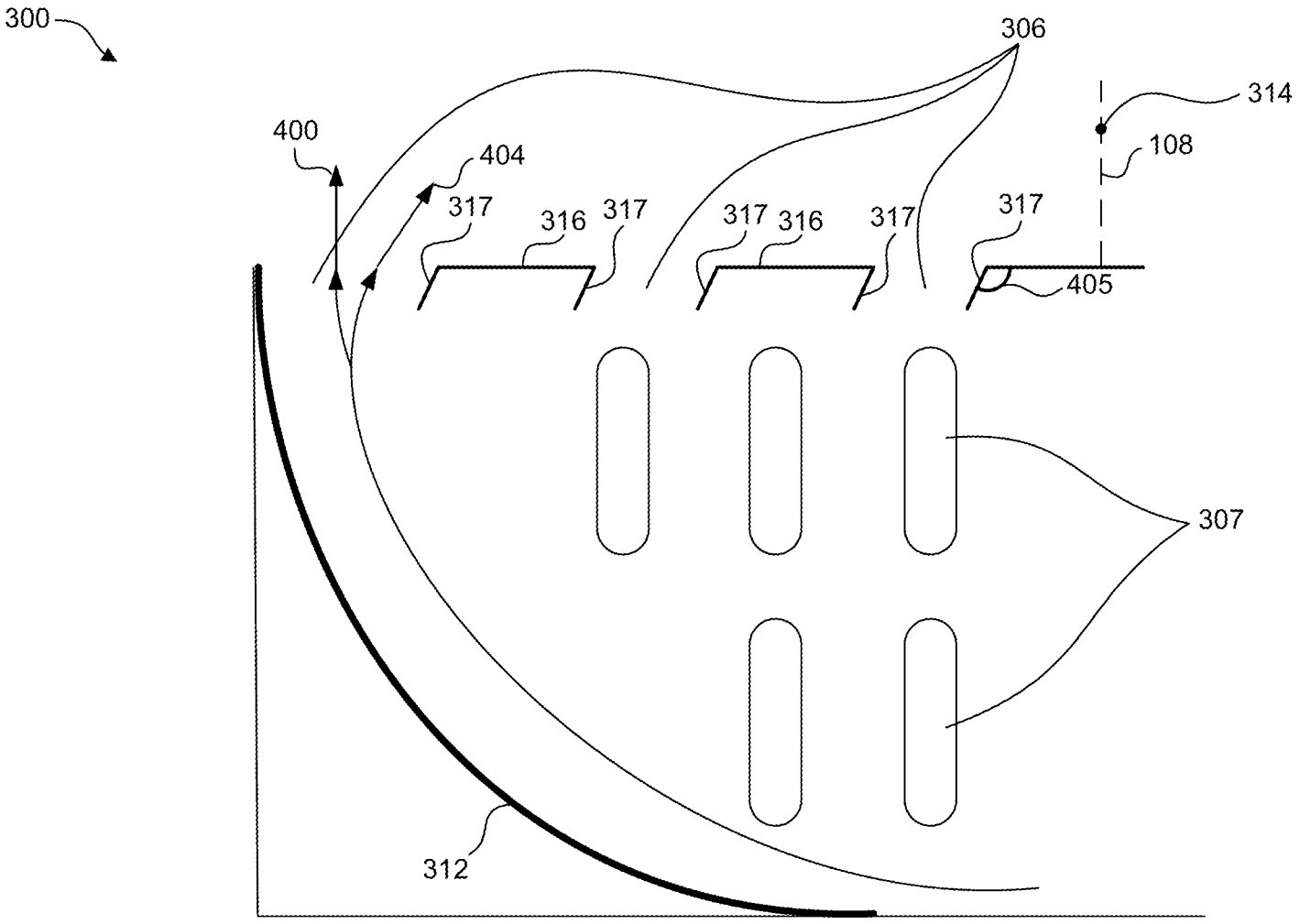
FIG. 5 shows a cross-sectional view of an airflow management system taken along the line 5-5' in FIG. 4 according to an embodiment.

FIG. 5 shows a cross-sectional view of airflow management system 300 taken at the line 5-5'. Airflow management system 300 includes arced plate 312. Arced plate 312 redirects air mass 400 exiting refrigeration unit 200. Arced plate 312 changes the direction of the flow of air mass 400 from the substantially horizontal trajectory air mass 400 has when exiting airflow outlet 210 to a substantially vertical trajectory. Arced plate 312 has radius 314. In some embodiments, arced plate 312 may have more than one radius 314 depending on the geometry of arced plate 312. In some embodiments, arced plate 312 may transition through 90°. In some embodiments, arced plate may transition through more or less than 90°. Still, in some embodiments, arced plate may have a piecewise transition.

Air mass 400's transition from horizontal flow to vertical flow introduces turbulence into air mass 400. In contrast to the generally smooth, laminar flow of air mass 400 when exiting refrigeration unit 200 via airflow channels 211, the turbulent portions of air mass 400 are characterized by chaotic local changes in pressure and flow velocity. The turbulent portions of air mass 400 interfere with the laminar portions of the flow and reduce the velocity of the flow. A reduce velocity of air mass 400 reduces the ability of air mass 400 to maintain a laminar flow across the height of transparent section height 110. Laminar flows across the surface increase the rate of heat transfer so the more laminar and less turbulent the flow, the greater the heat transfer on the transparent section.

Turbulence reduction vents 307, reduce the turbulence of air mass 400, increasing the laminar flow properties of the flow. Turbulence reduction vents 307, formed in side panels 304, allow portions of air mass 400 that have a flow velocity that is not substantially vertical to exit airflow management system 300 through turbulence reduction vents 307. The removal of turbulent portions of the flow of air mass 400. Removed turbulent flow will not interact with the smooth flow inside of airflow management system 300 and will not reduce the overall laminar velocity of air mass 400 flow through the system.

According to some embodiments, airflow management system 300 includes additional airflow management components. For example, FIG. 5 also shows flow deflectors 317. Flow deflectors 317 may be formed at discharge vents 306. Flow deflectors 317 may be formed at an angle 405 relative to intermediate vent portions 316. Intermediate vent portions 316 are portions of discharge panel 302 that are between discharge vents 306. Flow deflectors 317 may slightly redirect the flow of air mass 400 exiting airflow management system 300 through discharge vents 306. The slight redirection of air mass 400 with flow deflectors 317 may be necessary to fine tune the flow of air mass 400 to ensure a more laminar flow across transparent portion height 110. As shown in FIG. 5, flow deflectors 317 may be said to be biased in the direction of transparent portion 108. As shown, flow diverters are biased towards a plane that intersects radius 314 and is orthogonal to discharge panel 302.

Figure 6A:
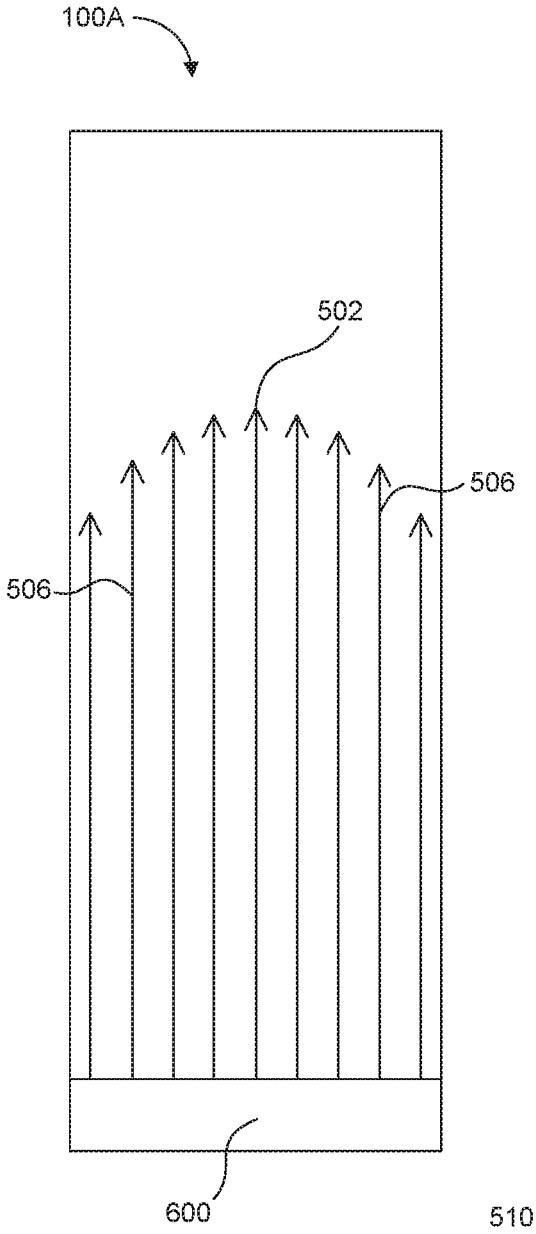
FIGS. 6A and 6B show flow vectors of an air mass up the front surface of a cooler according to an embodiment.
Figure 6B:
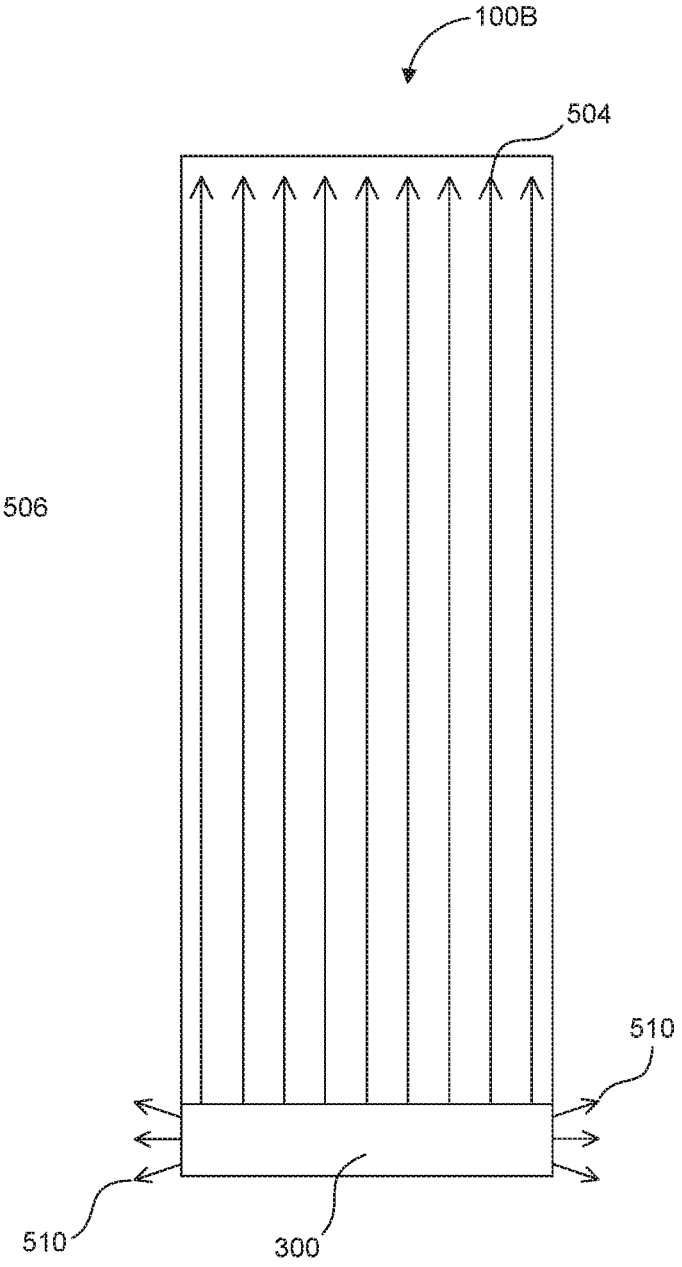

FIGS. 6A and 6B show flow diagrams of air mass 400 flowing across transparent portion 108. FIG. 6A shows cooler 100A having a flow diverter 60X). Flow diverter 600, has an arced plate configured to redirect air mass 400 exiting refrigeration unit 200 up transparent portion 108 of cooler 100A. While flow diverter 600 is similar in many respects to airflow management system 300 described above and includes discharge vents located on a discharge panel of flow diverter 600, flow diverter 600 lacks turbulence reduction vents 307. In contrast with cooler 100A shown in FIG. 6A, cooler 100B shown in FIG. 6B has airflow management system 300 as described above. Specifically, cooler 100B's airflow management system 300 includes turbulence reduction vents 307.

The flow diagrams shown in FIGS. 6A and 6B show flow vectors of air mass 400 exiting cooler 100A's flow diverter 600 and cooler 100B's airflow management system 300, respectively. The length of each flow vector corresponds to the length of the laminar flow across transparent portion 108. That is, the length of each vector shows how far up transparent portion height 110 the flow of air mass 400 remains smooth, laminar, and generally remains in contact with transparent portion 108.

FIG. 6A shows flow vectors of varying lengths and have a generally parabolic shape. The flow remains laminar across transparent portion 108 up to an extreme point 502. On average, the flow remains laminar to an average point 506.

FIG. 6B shows flow vectors of air mass 400 extending from airflow management system 300 up across transparent portion 108. FIG. 6B also shows flow vectors of air mass 510 extending from turbulence reduction vents 307. As shown, flow vectors extending up across transparent portion 108 remain laminar to point 504. In contrast to flow vectors shown in FIG. 6A, flow vectors in FIG. 6B remain laminar across the entire face of cooler 100B. Thus, air mass 400, heated by refrigeration unit 200, reaches the upper extremes of cooler 100B.

Figure 7A:
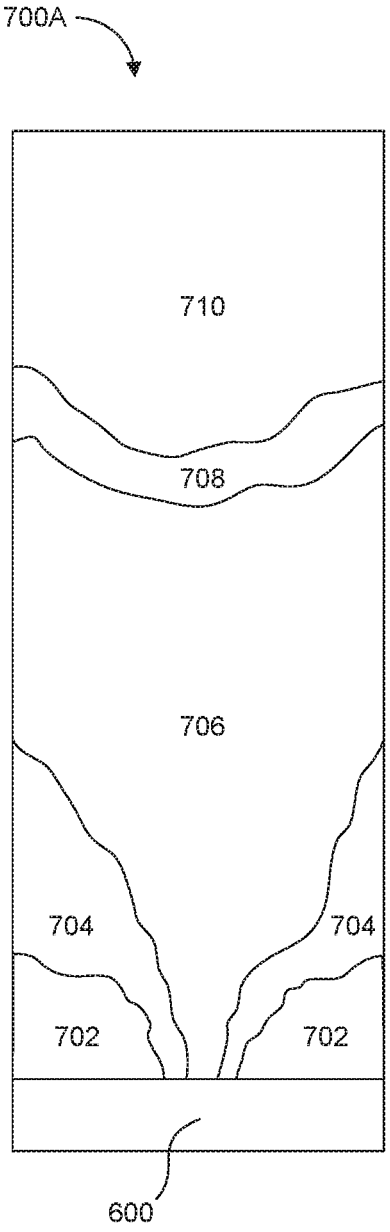
FIGS. 7A and 7B show a thermal map of the front surface of a cooler according to an embodiment.
Figure 7B:
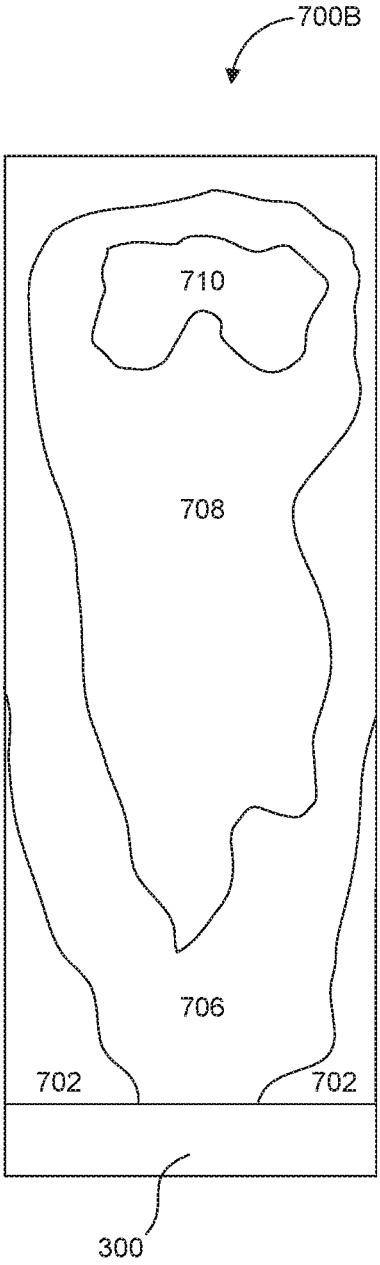

FIGS. 7A and 7B show heat diagrams of coolers 100A and 100B shown in FIGS. 6A and 6B. The heat diagrams show temperatures of transparent portion 108. FIGS. 7A and 7B show temperature zones 702, 704, 706, 708, and 710. Temperature zone 702 has a higher temperature than temperature zone 704. Temperature zone 704 has a higher temperature than temperature zone 706. Temperature zone 706 has a higher temperature than temperature zone 708. Temperature zone 708 has a higher temperature than temperature zone 710. Accordingly, temperature zone 702 is the highest temperature and temperature zone 710 is the lowest temperature.

As described above, as air mass 400 exits flow diverter 600 or airflow management system 300, air mass 400 is warmed by refrigeration unit 200. Air mass 400 transfers heat to across transparent portion 108. The transferred heat increases the temperature of across transparent portion 108 and results in the varying temperature zones 702 to 710. As the flow becomes less laminar and the temperature of air mass 400 decreases, the less heat transferred to transparent portion 108.

FIGS. 7A and 7B show temperature zone 710 on coolers 100A and 100B. As stated, temperature zone 710 is the lowest temperature on the surface of transparent portion 108. The low temperature of temperature zone 710 makes temperature zone 710 the most susceptible to the formation of condensation. A comparison of FIGS. 7A and 7B compares the effectiveness of flow diverter 600, which lacks turbulence reduction vents 307, and airflow management system 300, which includes turbulence reduction vents 307. On average, the surface temperature the transparent portion 108 of cooler 100B is higher than the surface temperature of the transparent portion 108 of cooler 100A. Thus, the transparent portion 108 of cooler 100B is less susceptible to the formation of condensation.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

What is claimed is:

1. A cooler comprising:

a cabinet having a door with a transparent section;

a refrigeration unit coupled to the cabinet, the refrigeration unit comprising:

an airflow inlet, an airflow outlet coupled to a bottom surface of the refrigeration unit, and a condenser disposed between the airflow inlet and the airflow outlet; and and an airflow management system comprising:

an airflow management system inlet in fluid communication with the airflow outlet of the refrigeration unit such that an air mass exits the airflow outlet of the refrigeration unit into the airflow management system inlet, one or more discharge vents, and one or more turbulence reduction vents, wherein the turbulence reduction vents are orthogonal to the discharge vents, wherein a cross sectional area of the airflow outlet is less than a cross sectional area of the airflow inlet such that when an air mass enters the airflow inlet and exists the airflow outlet the velocity of the air mass is greater at the airflow outlet than at the airflow inlet.

2. The cooler of claim 1, wherein the airflow management system is configured to redirect the flow of an air mass.

3. The cooler of claim 2, wherein the airflow management system redirects the flow of the air mass across the transparent section.

4. The cooler of claim 1, wherein a height of the transparent section is greater than 95% of a height of the cabinet.

5. The cooler of claim 1, wherein a height of the transparent section is greater than 85% of a height of the cooler.

6. The cooler of claim 1, wherein the condenser comprises coils, and wherein the coils of the condenser form air mass channels.

7. The cooler of claim 6, wherein the air mass channels are orthogonal to the door.

8. The cooler of claim 1, wherein the airflow management system lessens the formation of condensation on the transparent portion of the cabinet when:

an interior of the cabinet has a temperature below 8° C., and a height of the cabinet exceeds 6 ft, and wherein the cooler is located in an environment where:

a temperature exceeds 38° C., and a relative humidity exceeds 75%.

9. The cooler of claim 1, wherein a height of the transparent portion of the cabinet is between 6 ft and 6.5 ft.

10. The cooler of claim 1, wherein a width of the cross sectional area of the airflow outlet and a width of the cross sectional area of the airflow inlet are the same.

11. The cooler of claim 10, wherein the cabinet further comprises a secondary storage space, the secondary storage space formed above the airflow outlet of the refrigeration unit.

12. A cooler comprising:

a cabinet having a primary space having a primary space height and a secondary space having a secondary space height, the secondary space extending from the primary space, and the primary space height greater than the secondary space height;

a refrigeration unit having a first portion and a second portion, a height of the second portion being less than a height of the first portion such that an empty space is defined above the second portion;

an airflow management system fluidly coupled to the second portion, the airflow management system comprising an airflow management system inlet coupled to a bottom surface of the refrigeration unit and in fluid communication with the second portion of the refrigeration unit such that an air mass exits the second portion of the refrigeration unit into the airflow management system inlet; and a condenser disposed within the second portion, wherein the cabinet is disposed on the refrigeration unit, and wherein the secondary space comprises a storage compartment disposed within the empty space.

13. The cooler of claim 12, wherein the cabinet and the refrigeration unit form a rectangular profile.

14. A cooler comprising:

an airflow management system comprising:

a housing having a discharge panel and a side panel, discharge vents formed in the discharge panel, a turbulence reduction vent formed in the side panel, and an arced plate disposed within the housing and extending from a base of the housing, configured to redirect an air mass from a substantially horizontal trajectory to a substantially vertical trajectory and through the discharge vent formed in the discharge panel.

15. The cooler of claim 14, wherein the arced plate bends through 90 degrees.

16. The cooler of claim 14, further comprising deflectors, the deflectors formed at the discharge vents and biased towards a plane orthogonal to the discharge panel, the orthogonal plane intersecting a radii of the arced plate.

17. The cooler of claim 14, wherein the arced plate engages the side panel.

18. The cooler of claim 14, wherein the discharge vents comprise two rows.

19. The cooler of claim 14, wherein the vents on the discharge panel include two rows and ten columns.

20. The cooler of claim 14, wherein the discharge vents and the turbulence reduction vents are orthogonal.

* * * * *